United States Patent [19]

Jones

[11] Patent Number: 4,523,833

[45] Date of Patent: Jun. 18, 1985

[54] DEVELOPER ROLLER METERING BLADE

[75] Inventor: Thomas B. Jones, Brighton, N.Y.

[73] Assignee: Xerox Corporation, Stamford, Conn.

[21] Appl. No.: 546,266

[22] Filed: Oct. 28, 1983

[51] Int. Cl.[3] ..... G03G 15/09

[52] U.S. Cl. ..... 355/3 DD; 355/14 D; 118/658

[58] Field of Search ..... 355/3 DD, 14 D; 118/657, 658, 650; 430/122

[56] References Cited

U.S. PATENT DOCUMENTS

| | | | |
|---|---|---|---|
| 4,365,586 | 12/1982 | Hosono et al. | 118/657 |
| 4,406,536 | 9/1983 | Suzuki et al. | 355/3 DD |
| 4,466,730 | 8/1984 | Jugle | 355/14 D |
| 4,468,111 | 8/1984 | Yamagata et al. | 355/3 DD |

FOREIGN PATENT DOCUMENTS

| | | | |
|---|---|---|---|
| 111868 | 9/1981 | Japan | 355/3 DD |
| 8566 | 1/1982 | Japan | 355/3 DD |
| 210372 | 12/1982 | Japan | 355/3 DD |

*Primary Examiner*—R. L. Moses

*Attorney, Agent, or Firm*—H. Fleischer; J. E. Beck; R. Zibelli

[57] ABSTRACT

An apparatus in which a latent image recorded on an image receiving member is developed. A developer roller transports marking particles into the development zone. A blade having at least one aperture therein through which the marking particles pass has the free end portion thereof contacting the developer roller. A controller regulates the quantity of marking particles passing through the aperture in the blade. In this way, the thickness of the layer of marking particles on the developer roller is adjusted.

14 Claims, 4 Drawing Figures

DEVELOPER ROLLER METERING BLADE

This invention relates generally to an electrophotographic printing machine, and more particularly concerns an apparatus for developing a latent image recorded on a photoconductive surface.

Generally, the process of electrophotographic printing includes charging a photoconductive surface to a substantially uniform potential. The charged portion of the photoconductive surface is exposed to a light image of an original document being reproduced. This records an electrostatic latent image on the photoconductive surface corresponding to the informational areas contained within the original document. After the electrostatic latent image is recorded on the photoconductive surface, the latent image is developed by bringing a developer material into contact therewith. This forms a toner powder image on the photoconductive surface. Subsequently, the toner powder image is transferred to a copy sheet. Finally, the powder image is heated to permanently affix it to the copy sheet in image configuration.

In the foregoing type of printing machine, a development system is employed to deposit developer material onto the photoconductive surface. Generally, the developer material comprises toner particles, which are mixed with coarser carrier granules. Typically, the toner particles are made from a thermoplastic material with the carrier granules being made from a ferromagnetic ,material. Alternatively, the single component magnetic particle may be employed. A system utilizing single component magnetic developer material may be capable of high speeds. One type of development apparatus employing a single component magnetic material is described in U.S. Pat. No. 2,846,333 issued to Wilson in 1958. It has been found that when employing a single component developer material, it is highly desirable to meter a uniform layer of toner particles onto the developer material. Preferably, this layer of developer material is of a thin, controlled thickness. Uniform metering of a thin layer of toner particles, hereinbefore, placed stringent requirements on the mechanical design tolerances of the parts in the development system. In particular, it has been necessary to provide a uniform gap between the metering blade and the developer roller. This gap is of a very small width and the out of round condition of the developer roller relative to the positioning of the metering blade frequently introduced variations in the thickness of the layer of particles deposited thereon. Moreover, metering of a thin layer of particles onto the developer roller produced variations in the layer of thickness due to the non-uniformity in the particles. Thus, it would be highly desirable to be capable of metering precise quantities of particles onto the developer roller without having to take into account the out of round condition of the developer roller or the impurities in the particles. The following disclosures appear to be relevant:

U.S. Pat. No. 4,038,052, Patentee: Melcher et al., Issued: July 26, 1977.

U.S. Pat. No. 4,349,967, Patentee: Jones et al., Issued: Sept. 21, 1982.

U.S. Pat. No. 4,365,586, Patentee: Hosono et al., Issued: Dec. 28, 1982.

U.S. Pat. No. 4,373,272, Patentee: Jones et al., Issued: Feb. 15, 1983.

Co-Pending application Ser. No. 544,298, Applicant: Bares, Filed: 10-21-83.

The relevant portions of the foregoing disclosures may be briefly summarized as follows:

Melcher et al. discloses a fluidized bed of particles supported on a screen. An electrical field is impressed on the screen to prevent the particles from passing therethrough. Polluted gas moves through the screen and particles.

Jones et al. U.S. Pat. No. 4,349,967 discloses the use of a magnetic field in an inlet region for controlling the spouting of magnetizable granular material in a draft tube of a spouted bed vessel.

Jones et al. U.S. Pat. No. 4,373,272 describes semi-insulating granular particles in a spouted bed vessel. An electrical field controls the spouting of particles through an inlet tube.

Hosono et al. discloses a toner hopper disposed above a developer roller for dispensing toner particles thereon. The layer of the developer material formed on the developer roller is controlled by a doctor blade disposed in proximity to the surface of the developer roller. After termination of development of the electrostatic latent image recorded on the photoconductive surface, the develper material advances along the developer roller into contact with a developer removing blade. The developer removing blade has a plurality of rectangualr spaced holes or openings therein through which the developer material passes.

Bares describes a metering blade having a plurality of trapezoidal apertures therein. The free edge of the blade contacts the developer roller and a portion of the developer material being transported thereon passes through the apertures therein. In this way, the quantity of developer material on the developer roller is regulated.

In accordance with one aspect of the present invention, there is provided an apparatus for developing a latent image recorded on an image receiving member. The apparatus includes a housing defining a chamber for storing a supply of marking particles therein. Means transport the marking particles from the chamber in the housing to a development zone closely adjacent to the latent image recorded on the image receiving member. A member has a free edge thereof contacting the transporting means and at least one aperture therein closely adjacent to the free edge. A portion of the marking particles on the transporting means pass through the aperture in the member prior to being transported to the development zone. Means are provided for controlling the quantity of marking particles passing through the aperture in the member.

Pursuant to another aspect of the present invention, there is provided an electrophotographic printing machine of the type having a photoconductive member arranged to have a latent image recorded thereon. The printing machine includes a housing defining a chamber for storing a supply of marking particles therein. Means transport the marking particles from the chamber in the housing to a development zone closely adjacent to the latent image recorded on the photoconductive member. A member has a free edge thereof contacting the transporting means and at least one aperture therein closely adjacent to the free edge. A portion of the marking particles on the transport pass through the aperture in the member prior to being transported to the development zone. Means are provided for controlling the quantity of marking particles passing through the aperture in the member.

Other apsects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
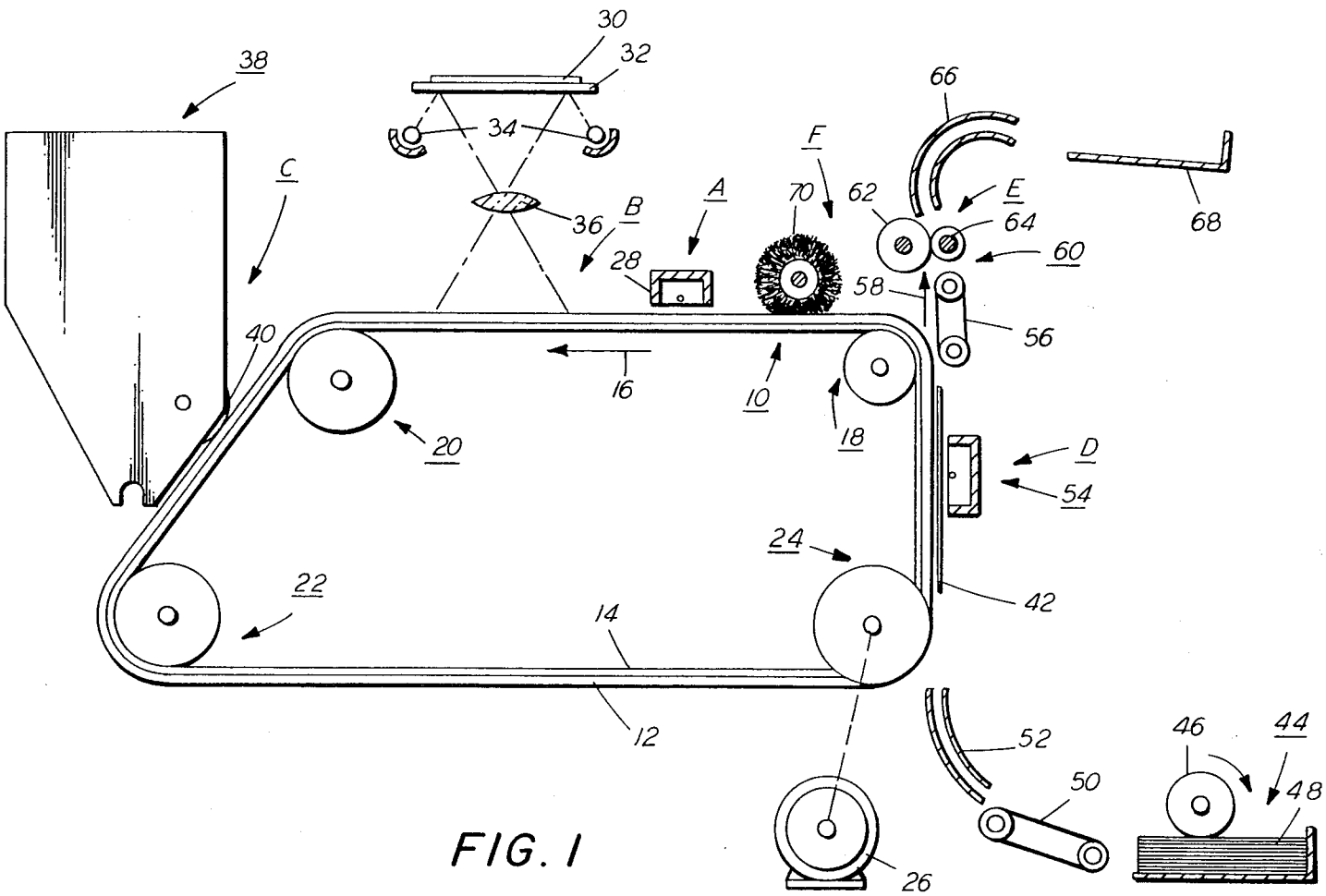
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative eletrophotographic printing machine incorporating the development apparatus of the present invention therein. It will become evident from the following discussion that this apparatus is equally well suited for use in a wide variety of electrostatographic printing machines and is not necessarily limited in its application to the particular embodiment depicted herein.

In this illustrative electrophotographic printing machine, as shown in FIG. 1, a belt 10 having a photoconductive surface 12 deposited on a conductive surface 14, moves in the direction of arrow 16. Preferably, the conductive substrate comprises a transparent support such as a poly(ethyleneterpothiolate)cellulose acetate or other suitable photographic film supports, typically having coated thereon a transparent conductive coating such as high vacuum operated nickel, cuperous iodide or any suitable conducting polymer. The conductive support is, in turn, overcoated with a photoconductive layer typically comprising a binder and an organic photoconductor. A wide variety of organic photoconductors may be employed. For example, an organic amine photoconductor or a polyarylalkylene photoconductor may be used. However, one skilled in the art will appreciate that any suitable organic photoconductor compatible with the transparent conductive substrate may be utilized in the present invention. Various types of photoconductors are described in U.S. Pat. No. 3,734,724 issued to York in 1973, the relevant portions thereof being hereby incorporated into the present application. In the exemplary electrophotographic printing machine, the photoconductive layer has an electrostatic charge of a negative polarity recorded thereon with the charge on the marking particles being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tension roller 20, idler roller 22 and drive roller 24. Drive roller 24 is mounted rotatably and in engagement with belt 10. Motor 26 rotates roller 24 to advance belt 10 in the direction of arrow 16. Roller 24 is coupled to motor 26 by suitable means such as a drive belt. Drive roller 24 includes a pair of opposed spaced edge guides. The edge guides define a space therebetween which determines the dsired path of movement of belt 10. Belt 10 is maintained in tension by a pair of springs (not shown) resiliently urging tension roller 20 against belt 10 with the desired spring force. Stripping roller 18, tension roller 20 and idler roller 22 are mounted rotatably. These rollers are all idler rollers which rotate freely as belt 10 moves in the direction of arrow 16.

Initially, a portion of belt 10 passes through charging station A. At charging station A, a corona generating device, indicated generally by the reference numeral 28, charges photoconductive surface 12 of belt 10 to a relatively high, substantially uniform potential having a negative polarity. One skilled in the art will appreciate that the polarity of the charge imposed upon the photoconductive surface depends upon the selected photoconductor material and a suitable photoconductor material may be utilized wherein a positive polarity is applied rather than a negative polarity.

Next, the charged portion of photoconductive surface 12 advances through exposure station B. At exposure staton B, an original document 30 is positioned facedown upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on the photoconductive surface having a negative polarity which corresponds to the informational areas contained within original document 30. Thereafter, belt 10 advances the electrostatic latent image recorded on photoconductive surface 12 to development station C.

At development station C, the magnetic brush development system of the present invention, indicated generally by the reference numeral 38, transports marking particles of a positive polarity into contact with the latent image recorded on photoconductive surface 12. The force exerted on the marking particles by the electrostatic image attracts the marking particles from developer roller 40 thereto. This forms a powder image on photoconductive surface 12 of belt 10 which corresponds to the informational areas contained within original document 30. The detailed structure of development system 38 will be described hereinafter with reference to FIGS. 2 and 3.

After development, belt 10 advances the powder image to transfer station D. At transfer station D, a sheet of support material 42 is moved into contact with the powder image. By way of example, the sheet of support material may be paper. The copy paper is advanced to transfer station D by a sheet feeding apparatus, indicated generally by the reference numeral 44. Preferably, sheet feeding apparatus 44 includes a feed roller 46 contacting the uppermost sheet of stack 48. Feed roller 46 rotates to advance the sheet from stack 48 onto conveyor 50. Conveyor 50 transports the sheet into chute 52 which guides sheet 42 into contact with photoconductive surface 12 of belt 10 in a timed sequence so that the powder image developed thereon contacts the advancing sheet 42 at transfer station D.

Transfer station D includes a corona generating device 54 which sprays negative ions onto the back side of sheet 42. In this way, sheet 42 is charged to an opposite polarity from the marking particles adhering to photoconductive surface 12 of belt 10. The powder image is attracted from photoconductive surface 12 to sheet 42.

After the marking particles have been transferred to sheet 42, conveyor 56 advances the sheet in the direction of arrow 58 to fusing station E. Fusing station E includes a fuser assembly, indicated generally by the reference numeral 60, which permanently affixes the transferred powder image to copy sheet 42. Preferably, fuser assembly 60 includes a heated fuser roll 62 and back-up roll 64. Sheet 42 passes between fuser roll 62 and back-up roll 64 with the powder image contacting fuser roller 62. In this manner, the powder image is permanently affixed to sheet 42. After fusing, chute 66 guides the advancing sheet to catch tray 68 for subsequent removal from the printing machine by the operator.

Invariably, after the copy sheet is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fibrous brush 70 in contact with photoconductive surface 12. The preclean corona generating device neutralizes the charge attracting the particles to the photoconductive surface. These particles are then cleaned from the photoconductive surface by the rotation of brush 70 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an illustrative electrophotographic printing machine incorporating the features of the present invention therein.

Figure 2:
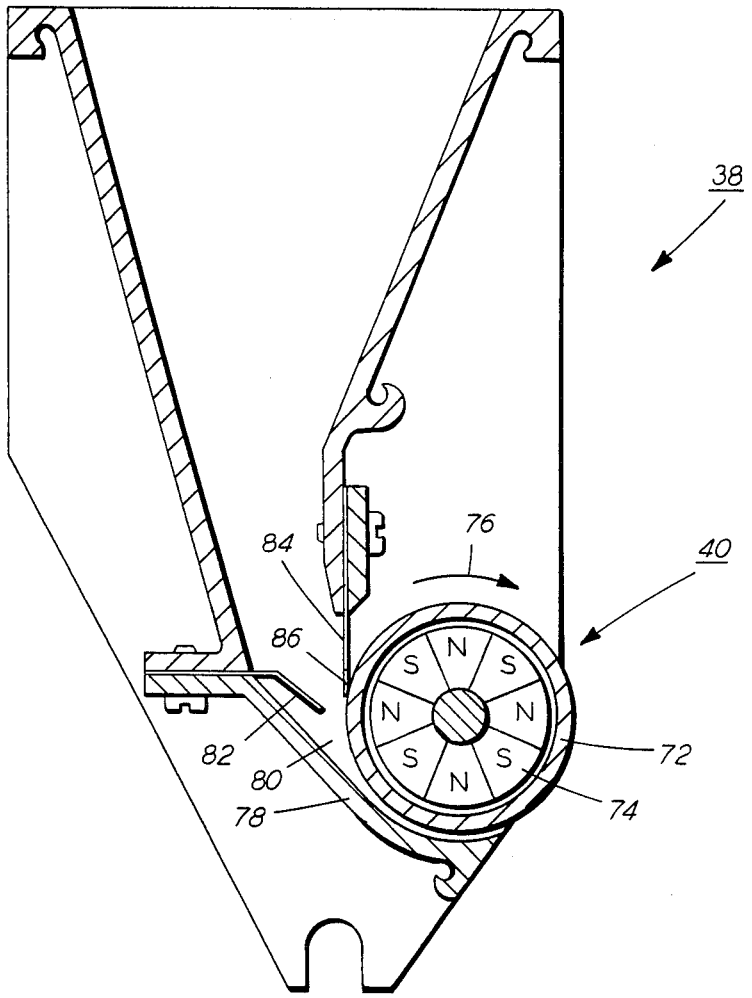
FIG. 2 is an elevational view showing schematically the development apparatus used in the FIG. 1 printing machine.

Referring now to FIG. 2, the features of the development apparatus of the present invention are shown in greater detail. As depicted thereat, development apparatus 38 includes a developer roller, indicated generally by the reference numeral 40. Developer roller 40 includes a nonmagnetic tubular member 72. Preferably, tubular member 72 is made from aluminum having a 0.15 millimeter thick layer of polyvinylidene fluoride coated thereon. Tubular member 72 is interfit over magnetic member 74. Preferably, magnetic member 74 is made from barium ferrite in the form of a cylindrical member having twelve magnetic poles impressed about the circumferential surface thereof. The maximum radial magnetic field at the surface of magnet 74 is about 650 gauss. Tubular member 72 rotates at a tangential velocity ranging from about 16 centimeters per second to about 58 centimeters per second. Magnet 74 rotates at an angular velocity ranging from 1000 rpm to 1500 rpm. In this way, the marking particles move in the direction of arrow 76. Housing 78 stores a supply of marking particles in chamber 80 thereof. Initially, the marking particles advance beneath pre-metering blade 82. The free edge of blade 82 is spaced a distance ranging from 1 to 2 millimeters from the surface of tubular member 72. After the layer of marking particles has passed through the gap between the free end of metering blade 82 and the surface of tubular member 72, blade 84 controls the resultant layer of marking particles advanced closely adjacent to the latent image recorded on photoconductive surface 12 of belt 10, i.e. the development zone. The free end portion of blade 84 is resiliently urged into contact with the surface of tubular member 72. The other end of blade 84 is attached to housing 78. Blade 84 has a plurality of apertures 86 through which the marking particles pass. An imposed electrical field controls the quantity of marking particles passing through apertures 86 in blade 84. Preferably, blade 84 is about 0.05 millimeters thick. The free end of blade 84 forms an angle with the surface of tubular member 72 about 15°. The detailed structure of blade 84 is depicted in FIGS. 3 and 4.

Figure 3:
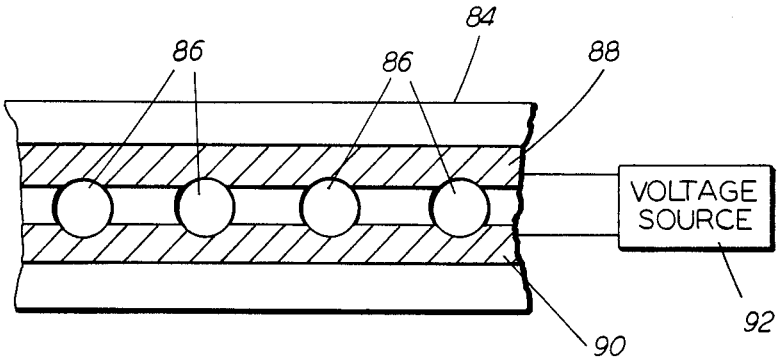
FIG. 3 is a fragmentary, plan view showing one embodiment of the metering blade employed in the FIG. 2 development system.

As shown in FIG. 3, blade member 84 includes a plurality of apertures or holes 86 of a circular cross section. Preferably, blade member 84 is made from a thin, plastic material. However, any insulating material suitable for a blade may be used. Electrodes 88 and 90 are integral with blade member 84 and may be fabricated photolithographically thereon. Voltage source 92 is electrically connected to electrodes 88 and 90. The marking particles passing through holes 86 are preferably semi-insulating. Thus, the marking particles are not so highly insulating that their electromechanical response to an imposed electric field would be largely determined by relatively uncontrolled factors such as frictional electrification. On the other hand, the marking particles are not so highly conducting as to impose a limitation on the strength of the fields that can be imposed due to electrical breakdown or electrical heating. Since conduction in the present invention typically occurs on the surface of the marking particles, the electrical conduction thereof is often determined by relative humidity. Accordingly, relatively insulating marking particles may be semi-insulating in a given environment. Thus, the term semi-insulating marking particles, as used herein, includes particles having relative conductive surfaces in an environment of interest which marking particle and other environments or applications may be considered as being relatively insulating or relatively conducting. A suitable type of marking particles comprises 40 percent by weight of magnetite, 59.9 percent by weight of a polymer resin and charge control agent, and 0.5 percent by weight of an aluminum oxide flow agent blended into the marking particles after fabrication. The marking particles respond to strong electrical fields by forming interlocking chain-like structures. The strength of these chains and the extent of interlocking is controlled by the electrical field intensity and nonuniformity. If the electrical field is sufficiently strong, a mass of such particles can freeze into a solid mass, called an electropacked bed, behaving somewhat like a cohesive powder. However, the electropacked bed will flow if the electrical field is reduced or removed. Thus, flow control can be achieved by adjusting a static, dc voltage. Voltage source 92, coupled to electrodes 88 and 90 of blade 84, creates an electrical field at holes 86 therein. By adjusting the level of voltage source 92, the intensity of the electrical field in holes 86 may be controlled, and in turn, the quantity of marking particles passing therethrough regulated. Not only may the level be controlled, but marking particles may acutally be prevented from passing through apertures 86 by adjusting the intensity of the electrical field to a suitable level. Thus, an on/off type of control may also be achieved.

Figure 4:
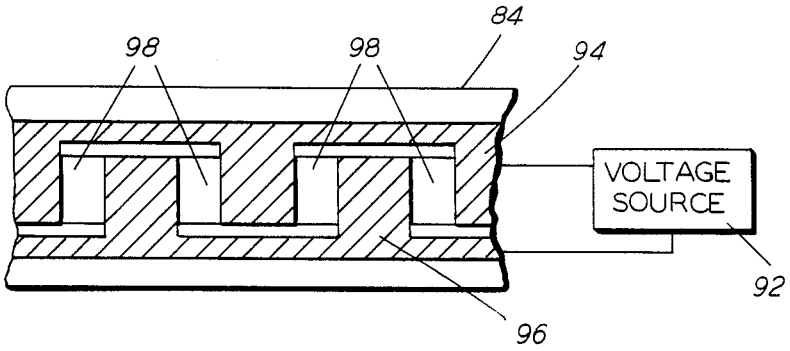
FIG. 4 is a fragmentary, plan view showing another embodiment of the metering blade used in the FIG. 2 development system.

Turning now to FIG. 4, there is shown another embodiment of metering blade 84. As depicted thereat, metering blade 84 includes a plurality of substantially equally spaced rectangular apertures 98 therein. Electrodes 94 and 96 are photolithographically fabricated on the insulating surface of blade 84. Voltage source 92 is electrically connected to electrodes 94 and 96. Once again, by suitably adjusting the level of voltage source 92, the intensity of the electical field in holes 92 may be adjusted to regulate the quantity of marking particles passing therethrough.

One skilled in the art will appreciate that a magnetic field may be employed in lieu of an electrical field. Thus, if the marking particles and blade are made from a magnetizable material, an eletromagnet may be employed to produce a variable magnetic filed in the holes of the blade. By suitably adjusting the intensity of this magnetic field, the quantity of particles passing therethrough may be regulated.

In recapitulation, the development apparatus of the present invention includes a developer roller for advancing a defined amount of marking particles into a development zone closely adjacent to a latent image recorded on a photoconductive surface. A blade having a plurality of apertures therein has the free end thereof contacting the developer roller. The marking particles advance from a storage chamber through the apertures in the blade into the development zone. An electrical field regulates the quantity of marking particles passing through the apertures in the blade. In the development zone, the electrostatic latent image attracts a portion of the marking particles from the developer roller forming a powder image thereon. By utilizing a precisely controlled layer of marking particles on the developer roller, the resultant powder image formed on the photoconductive surface optimizes copy quality.

It is therefore, evident that there has been provided in accordance with the present invention an apparatus which fully satisfies the aims and advantages hereinbefore set forth. While the invention has been described in conjunction with various embodiments thereof it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing a latent image recorded on an image receiving member, including:

a housing defining a chamber for storing a supply of marking particles therein;

means for transporting the marking particles from the chamber in said housing to a development zone closely adjacent to the latent image recorded on the image receiving member;

a member having a free edge thereof contacting said transporting means and at least one aperture therein closely adjacent to the free edge through which a portion of the marking particles on said transporting means pass through prior to being transported to the development zone; and means for controlling the quantity of marking particles passing through the aperture in said member.

2. An apparatus according to claim 1, wherein said member is a blade interposed between the chamber in said housing and the development zone.

3. An apparatus according to claim 2, wherein said blade includes a plurality of substantially equally spaced apertures therein.

4. An apparatus according to claim 3, wherein said blade is attached to said housing with the free end thereof being in resilient contact with said transporting means.

5. An apparatus according to claim 2, wherein said controlling means electrically biases the region of said blade adjacent the aperture therein with the magnitude of the electrical field controlling the quantity of marking particles passing therethrough.

6. An apparatus according to claim 5, wherein said blade member includes an electrically conductive region electrically connected to said biasing means, said electrically conductive region surrounding the aperture in said blade and comprising a first portion electrically insulated from a second portion thereof by the aperture in said blade.

7. An apparatus according to claim 6, wherein said transporting means includes:

a tubular member; and an elongated magnetic member disposed interiorly of and spaced from said tubular member.

8. An electrophotographic printing machine of the type having a photoconductive member arranged to have a latent image recorded thereon, wherein the improvement includes:

a housing defining a chamber for storing a supply of marking particles therein;

means for transporting the marking particles from the chamber in said housing to a development zone closely adjacent to the latent image recorded on the photoconductive member;

a member having a free edge thereof contacting said transporting means and at least one aperture therein closely adjacent to the free edge through which a portion of the marking particles on said transporting means pass through prior to being transported to the development zone; and means for controlling the quantity of marking particles passing through the aperture in said member.

9. A printing machine according to claim 8, wherein said member is a blade interposed between the chamber in said housing and the development zone.

10. A printing machine according to claim 9, wherein said blade includes a plurality of substantially equally spaced apertures therein.

11. A printing machine according to claim 10, wherein said blade is attached to said housing with the free end thereof being in resilient contact with said transporting means.

12. A printing machine according to claim 11, wherein said controlling means electrically biases the region of said blade adjacent the aperture therein with the magnitude of the electrical field controlling the quantity of marking particles passing therethrough.

13. A printing machine according to claim 12, wherein said blade member includes an electrically conductive region electrically connected to said biasing means, said electrically conductive region surrounding the aperture in said blade and comprising a first portion electrically insulated from a second portion thereof by the aperture in said blade.

14. A printing machine according to claim 13, wherein said transporting means includes:

a tubular member; and an elongated magnetic member disposed interiorly of and spaced from said tubular member.

* * * * *